United States Patent [19]

Goldberg

[11] 4,409,950

[45] Oct. 18, 1983

[54] FUEL SAVER AND POLLUTION CONTROL DEVICE

[76] Inventor: Nathan Goldberg, A-217 Oak Summit Apartments, 310 S. Easton Rd., Glenside, Pa. 19038

[21] Appl. No.: 261,606

[22] Filed: May 7, 1981

[51] Int. Cl.[3] ..... F02M 25/06

[52] U.S. Cl. ..... 123/573; 123/572

[58] Field of Search ..... 123/572, 573, 574, 41.86

[56] References Cited

U.S. PATENT DOCUMENTS 3,877,451 4/1975 Lipscomb ..... 123/573

4,089,309 5/1978 Bush ..... 123/573

4,269,607 5/1981 Walker ..... 123/573

4,370,971 2/1983 Bush ..... 123/573

*Primary Examiner*—Ronald H. Lazarus

*Attorney, Agent, or Firm*—Thomas A. Lennox

[57] ABSTRACT

A fuel saving and pollution control device is connected in the vapor conduit between the crank case and the intake manifold of an internal combustion engine wherein vapors are drawn through the unit that includes a filter and a water condensing grid. The unit passes burnable vapors but removes large particulates, resins and high molecular weight materials. Water condensate collected after engine operation is injected to the intake manifold upon restart.

20 Claims, 6 Drawing Figures

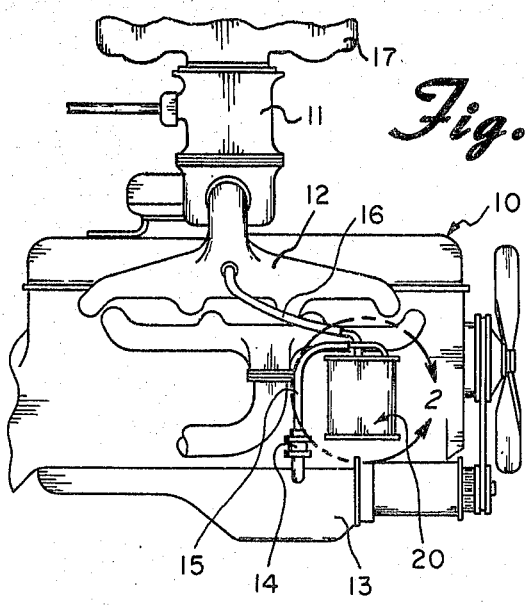
Fig. 1
Fig. 2
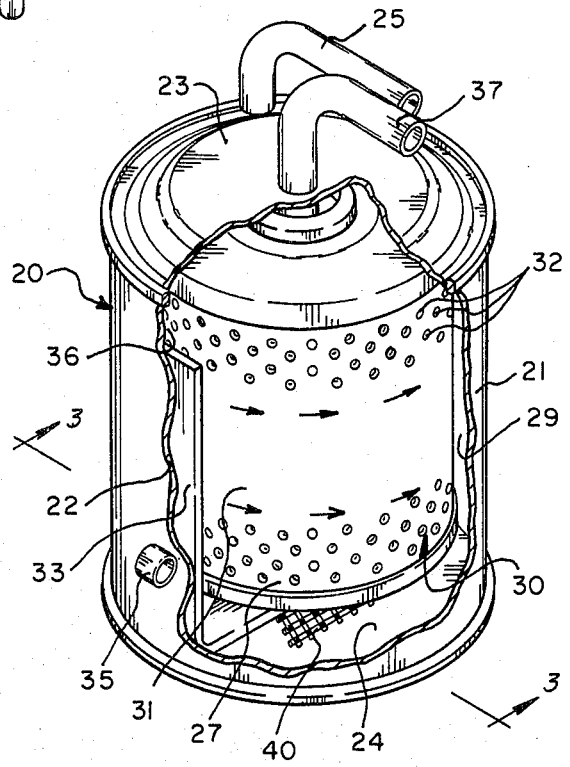
Fig. 3
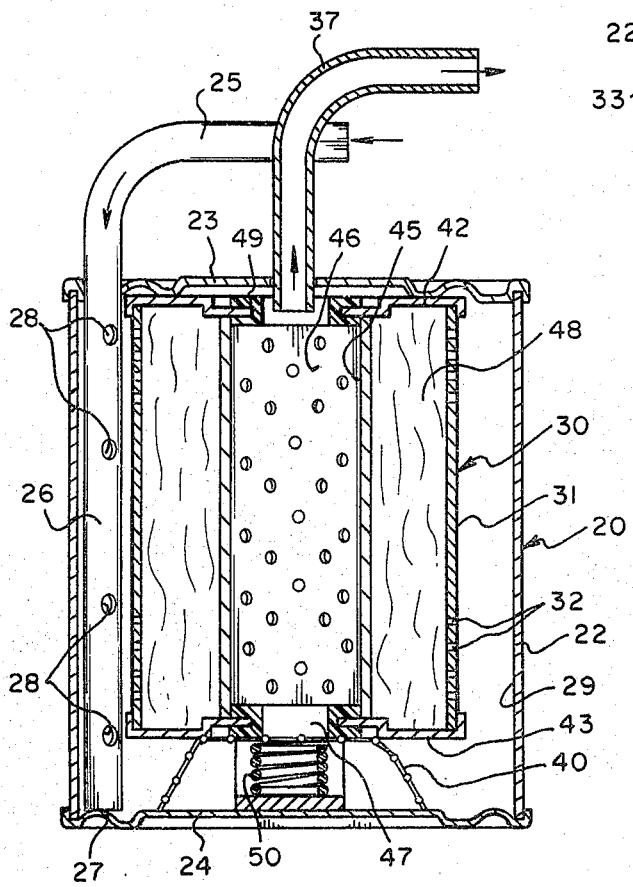

FUEL SAVER AND POLLUTION CONTROL DEVICE

BACKGROUND OF INVENTION

1. Field of the Invention

In the operation of internal combustion engines a certain amount of combustion gases escape past the piston rings into the crank case. In addition, the lubricating oil in the crank case of an internal combustion engine is degraded to lower molecular weight hydrocarbons that become vaporized, due to engine heat and turbulence during engine operation. In the past, these vapors from the crank case have been allowed to vent to the atmosphere through a breather pipe. This was not desirable as the vapors contain sulfur, carbon monoxide and other substances which adversely affect the atmosphere. In order to reduce air pollution, these fumes are typically drawn directly by vacuum from the PCV valve to the intake manifold or the air intake of the engine via a flexible conduit. However, these vapors include not only combustible substances such as oil, hydrocarbon break-down products, but also less combustible materials such as carbon, solid products of combustion, acids, high molecular weight resins and other undesirable materials. It is preferred that these undesirable, less combustible products not be introduced directly into the combustion chambers of the engine.

In addition, it is generally known that water injected into the intake manifold will act as a cleaning agent as it enters the internal combustion engine chamber. Water vapor coming into contact with incandescent carbon deposits in the combustion chambers combines with the hot carbon in the so-called "water gas" reaction. The products of the water gas reaction, chiefly carbon dioxide and carbon monoxide, are expelled from the combustion chambers into the exhaust manifold. The reaction cleans the combustion chamber.

2. Description of Prior Art

A number of patents disclose devices for various purposes in the vacuum line between the crank case and the intake manifold or the carburetor. These include U.S. Pat. No. 3,250,263 to F. W. Gerjets, U.S. Pat. No. 3,509,967 to P. K. Ballard, U.S. Pat. No. 3,664,314 to Clifford L. Lamkin, U.S. Pat. No. 3,137,284 to Hultgren, U.S. Pat. No. 3,259,177 to Ritchie, U.S. Pat. No. 3,151,604 to Walker, U.S. Pat. No. 3,326,198 to Jackson, et al., U.S. Pat. No. 3,073,293 to Barker, and U.S. Pat. No. 3,877,451 to Lipscomb. None of these illustrate the present invention.

Additional devices disclosed in U.S. Pat. No. 3,175,546 to J. H. Roper, U.S. Pat. No. 3,236,216 to T. G. Van Dolah, U.S. Pat. No. 2,642,052 to Wagner, et al., and U.S. Pat. No. 3,834,365 to Issac S. Ussery illustrates the use of fluid scrubbing systems inserted in the same line.

A number of patents disclose the introduction of water by various means to the intake manifold such as U.S. Pat. No. 1,350,079 to T. A. Mulkern, U.S. Pat. No. 3,139,873 to D. L. Gardner, U.S. Pat. No. 3,173,408 to A. E. Brenneman, U.S. Pat. No. 3,259,117 to J. M. Ritchie, U.S. Pat. No. 1,352,649 to G. H. Blake, U.S. Pat. No. 3,530,842 to Joe W. VonBrimer, U.S. Pat. No. 3,557,763 to Stephen C. Probat and U.S. Pat. No. 3,712,281 to Arthur P. Ruth. None of these devices disclose the present invention or offer the combination of improvements in performance of the internal combustion engine attained by the present invention, nor due they satisfy the following objects.

SUMMARY OF THE INVENTION

An object of my invention is to provide an apparatus which will treat the vapors drawn from the crank case in such a fashion as to provide a more efficient burning vapor.

It is an additional object of this invention to provide an apparatus inserted in the vacuum line connecting the crank case to the intake manifold or the air intake that will introduce limited quantities of water vapor to periodically clean the combustion chambers of the internal combustion engine.

It is a further object to provide an apparatus that while removing large particulate impurities and high molecular weight materials, passes essentially all of the combustible materials to the combustion chambers to increase the burnable fuel and increase the efficiency of the engine operation.

It is an additional object of this invention to provide an apparatus which by removal of efficiency draining impurities but passing through combustible vapors, including periodic water injection, will reduce the fuel consumption of the internal combustion engine.

It has been found the vapors drawn from the crank case to the intake manifold include not only oil but a significant quantity of water, carbon, metals of various types and in various compounds, acids, and various high molecular weight materials known generally in the trade as shellac, varnish and the like, all of which tend to reduce the efficiency of the enginer operation. A particular problem is the collection of carbon, varnish and shellac in the combustion chamber. This build-up causes secondary ignition problems, inefficient combustion and reduced life of the engine. It is an object of this invention not only to restrict the flow of undesirable materials that enter the combustion chamber but it is also an object to remove such materials that form within the combustion chamber during engine operation.

It is a further object to substantially reduce the introduction of such products into the combustion chamber from the crank case and in particular remove the large particulate materials and high molecular weight impurities and provide a means for cleaning the combustion chamber of the engine to remove shellac, varnish and carbon depositions.

While it is recognized that water injection cleans the interior of the combustion chamber, it has been found that large quantities of water injection cause continual cleaning with reduced efficiency of the normal combustion process. Water injection on a continuous basis also contributes to degradation of the combustion chamber walls. Therefore, it is an object of this invention to provide a system with the capability to condense a limited amount of water vapor only when the engine has stopped and the surrounding air cools the system sufficiently to allow vapor to condense.

It is an additional object of this invention to provide a filtration device to satisfy the above, to provide a safety mechanism in case of filter clogging, such that flow from the crank case will not be significantly interrupted in case the filter is not changed per operating instructions.

It is an additional object of this invention to provide a filtration and water injection device which, despite great internal pressure changes, will not collapse during operation and will maintain all seals to provide a continuous flow through the filter despite large pressure and temperature changes.

It is a further object of this invention to provide a water condensation device which will collect water from the vapor emitting from the crank case and maintain it in a separate and relatively unadulterated form within the device.

The objects of this invention are obtained by the introduction in the vacuum line between the crank case and the intake manifold or the air intake, a housing with a flow inlet aperture in the housing, connected through the conduit from the crank case ventilation valve, with a flow disbursing mechanism as an extension of the inlet flow inside the housing that divides and directs vapor flow in a direction parallel to oblique to the interior surface of the housing. This flow disbursing mechanism is preferably a vertical tube connected to the flow inlet that is closed at the far end having a plurality, more preferably three to ten ports along the tube directed to a space parallel to the interior wall of the housing, directing flow around the interior periphery of the housing. If the preferable cylindrical housing is utilized, the flow is in a circular direction around a cylindrical filter located in the center of the housing. A filter is located in the central portion of the housing having an entrance face for the vapor flow and an exit face for the vapor flow after filtration. The filter medium is chosen to provide the capability of removing particulate impurities and high molecular weight by-products passing through the conduit into the housing, but having the capability of passing essentially all vapors and lower molecular weight combustible materials to the exit face. The filter is preferably a cylindrical tubular shape with the outside surface having the inlet face and the inside surface of the tube having the exit face, opening to a clear cylindrical passageway, the length of the cylindrical filter. Preferably, the top of the cylindrical filter is sealed against the top of the housing surrounding the outlet flow and the bottom of the filter is held above the bottom of the housing well above any possible accumulation of oils and contaminants collecting in the bottom of the housing. In this preferred embodiment, the flow path of the vapors entering the housing is in the space between the inside face of the side of cylindrical housing and the outside surface of the cylindrical shaped filter and the vapors pass across the inlet face on the outside surface of the cylinder and ultimately enter into the inlet face for filtration purposes. A sealing system is provided to seal a flow cavity opening to the exit face of the filter against the interior surface of the housing to allow flow communication from the exit face to a flow outlet in the housing wall communicating with the conduit to the air intake of the engine. A spring mechanism is provided creating a bias pressure against the filter forcing it against the sealing device. In the preferred embodiment utilizing a cylindrical filter, the spring provides a bias pressure on the filter in an upwardly vertical direction maintaining the filter against the seal located in the top of the filter to the top of the housing. A passageway is provided directly from the flow inlet to the flow outlet without passing through the filter and a safety closure of the passage is provided capable of opening only upon pressure build-up in the housing. This "pressure build-up" occurs when the filter becomes clogged or there is some other obstruction in the flow through the filtration system to the air intake means. When the engine is running, there is a substantial vacuum on the entire system, drawing the vapors through the filtration system to the air intake. If there were a blockage, the pressure could increase sufficiently to collapse the housing and/or cause breakage of the system. The safety closure is designed to open the direct flow passage to the flow outlet before collapse or breakage of the system. The closure may be a piece of adhesive tape completely closing the bottom of the internal passageway in the cylindrical filter or may be a commercial device known as a "circular flapper valve," which in either case includes a tear start such that when there is sufficient pressure build-up, the closure breaks through, tearing open without allowing any parts of the closure to enter into the vapor steam. It is preferred that the housing be cylindrical and be constructed of a ductile material capable of deflecting with pressure changes within the housing without collapsing or forming permanent deformation. The preferred closure is a film sealably attached across and closing the direct passage, wherein the film is provided with a tear start means, wherein the length and shape of the tear start and the tear strength of the film are chosen to resist opening during normal use, but to tear open when a substantial pressure build-up occurs within the housing. The term "film" is intended to include thin as well as thick material, typically plastic polymer of a thickness preferably in the range of 1 to 50 mils, more preferably with fibrous reinforcement. A condensation device is positioned in the housing capable of collecting and holding water condensate separate from any accumulated solid particulate, solid deposits or heavy oily liquid condensate collected within the housing. It is preferred that the condensation means not be in any physical contact with any other structure within the device and be suspended out of contact with any of the surfaces capable of collecting depositions. It is more preferred that the condensation device be located and be self supporting directly in the path of the vapor flow out of the disbursing device. It is preferred that the condensation device be a screen held and extending upwardly into the vapor flow between the entrance face of the filter and the interior surface of the housing. It is preferred that a baffle means also be provided in that same space, directly in the path of the inlet flow of a shape to disrupt the laminar flow of the vapor. The baffle device more preferably is a pair of metal plates of sufficient rigidity and strength such that collapse of the container housing to the baffle plates will be prevented from further collapse as a further safety device.

BRIEF DESCRIPTION OF THE DRAWINGS

FIG. 1 is a side view diagram of an automobile internal combustion engine showing positioning of an embodiment of this invention.

FIG. 2 is a perspective view of an embodiment of this invention with a cut away showing the internal positioning of the elements of this invention.

FIG. 3 is a vertical section of the embodiment of this invention taken along line 3—3 of FIG. 2.

DESCRIPTION OF PREFERRED EMBODIMENTS

Figure 4:
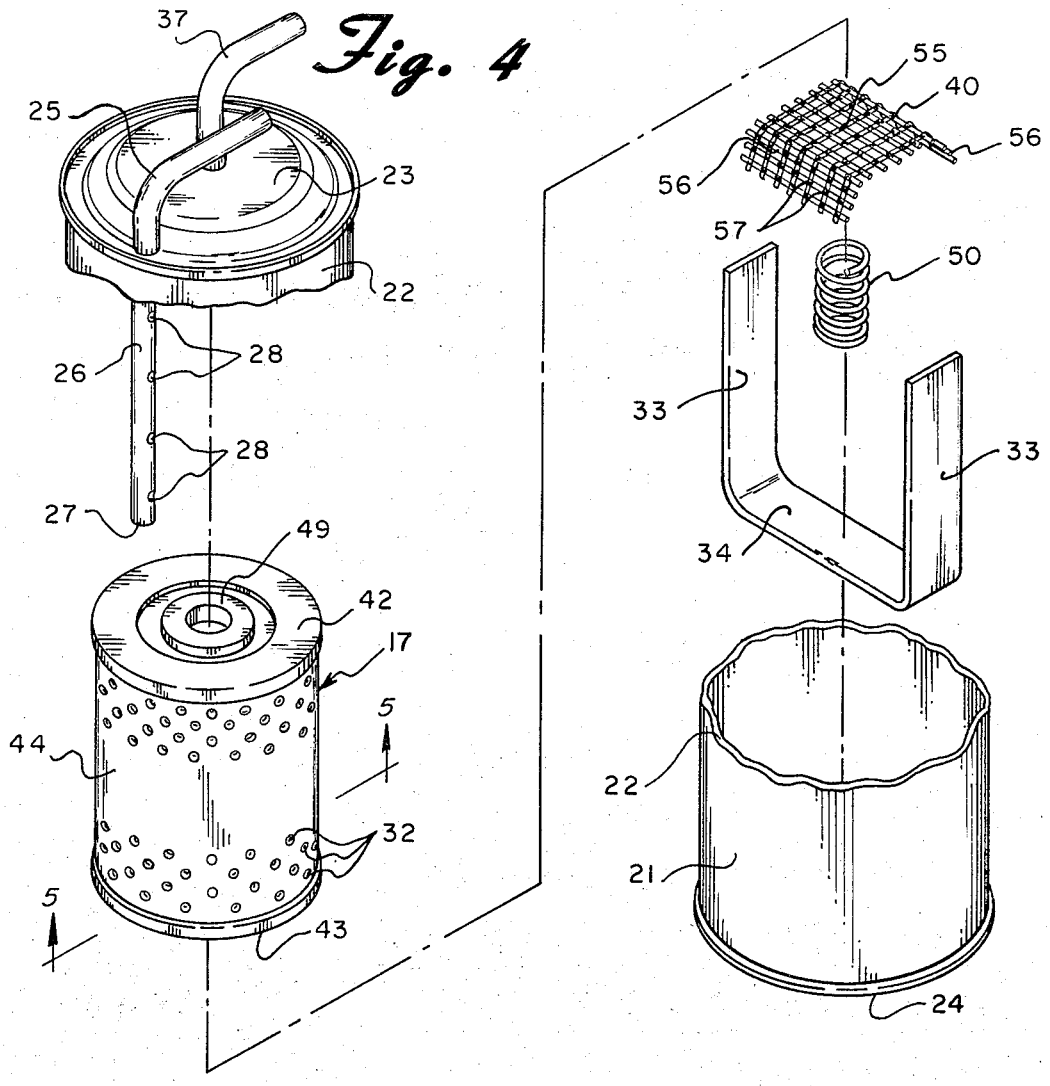
FIG. 4 is an exploded view of the device pictured in the above figures.

FIG. 1 illustrates the side view of a typical internal combustion engine 10 which is used to power an automobile. Carburetor 11 is depicted in its normal position attached to intake manifold 12. Positive crank case vent (PCV) valve 14 in connected to crank case 13. Fuel saver and pollution control device 20 is connected by flexible conduit 15 to valve 14 also connected through flexible conduit 16 to manifold 12. While device 20 is shown inserted directly in the standard vacuum line from PCV valve 14 to manifold 12. Device 20 is also effective if the engine is designed to have the vapors from the PCV valve conveyed to the air intake of carburetor 11 or air filter 17. In some engine designs the PCV valve is within the crank case, but the effectiveness of devise 20 is not affected.

FIG. 2 is a partially cut-away perspective view of an embodiment of this invention generally described as a fuel saver, engine cleaning and pollution control device for the improvement of engine performance and reduced fuel usage, referred hereinafter as device 20. Referring also to FIG. 3, housing 21 comprises welded seamed tube 22 constructed of 135 lb. test steel, $\frac{1}{3}$ lb. tin plate. Housing 21 is formed by edge crimping and adhesively sealing top 23 and bottom 24 closing the ends of tube 22. Both top 23 and bottom 24 are constructed of 135 lb. test steel, $\frac{1}{3}$ lb. tin plate, ribbed for additional strength to prevent collapse when vacuum is applied to housing 21. It is preferred that tube 22 not be ribbed to allow expansion and contraction with pressure changes. The capacity of housing 21 is typically about one quart liquid, however, the size is not critical to the invention. The size depends upon the size of the filter allowing sufficient annular space 36 around the filter for vapor flow shown by arrows, the size of the engine, the amount of particulate and high molecular weight materials carried out of the crank case through PCV valve 14 through tube 15 to unit 20, and the life of unit 20 desired before replacement. For example, a large diesel engine would utilize a gallon capacity for housing 21. Support ring 35 is a $\frac{1}{4}$ inch ring welded to tube 22 to provide a convenient means of holding device 20 in place under the hood.

Inlet tube 25 connects to flexible conduit 15 and is constructed of a $\frac{3}{8}$ inch copper, soldered to top 23 as it passes through and communicates with the interior of housing 21. The size of tube 25 depends upon the size of conduit 15 which is supplied with the engine and in turn dependent upon the vapor flow designed into the system. Tubes and conduits one-half inch in diameter are common. The tubes are chosen without unit 20 in the system. Inlet tube 25 extends into vertical tube 26, sealed at end 27 with a series of $\frac{1}{8}$ inch holes 28 angled to direct vapor flow parallel to inside surface 29 for flow around space 36 outside annular filter unit 30 as depicted by the arrows of FIG. 2 and FIG. 3. Surface 31 is plastic or clay treated oil and gasoline resistant paper or metal perforated at various position with holes 32. Baffle plates 33 constructed of $\frac{1}{8}$ inch thick steel plates act as a baffle to disrupt laminar flow around space 36 from vertical tube 26 and also provide support and rigidity to prevent can collapse. Vapor flow enters through holes 32 not close to tube 26. Outlet tube 37 is a $\frac{3}{8}$ inch copper tube soldered and sealed on top 23 and connected to flexible conduit 16 which provides vapor flow to intake manifold 12. Condensing screen 40 is shown in position to the space between filter unit 30 and bottom 24. This space is sufficient to collect oil condensate and other high molecular weight fluids which collect after extended operation of unit 20.

Figure 5:
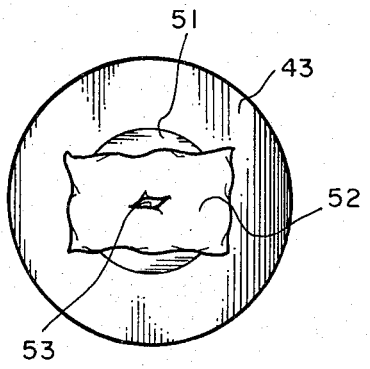
FIG. 5 is a bottom view of the bottom of the filter illustrated in FIG. 4.
Figure 6:
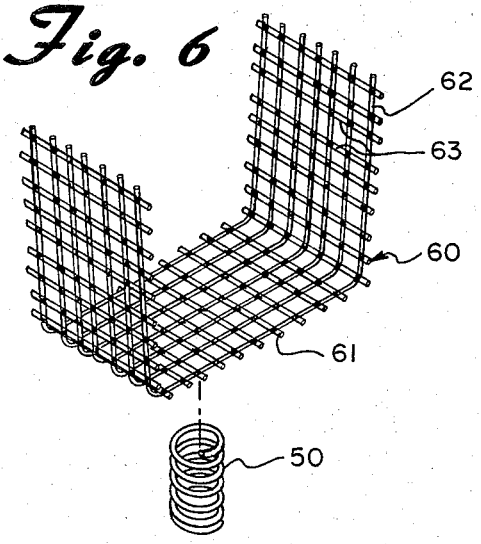
FIG. 6 is a perspective view of another embodiment of a condensation grid used in this invention.

FIG. 3 is a cross-sectional view of unit 20 which further displays filter 30. Filter 30 is constructed of filter top 42 and filter bottom 43 composed of treated paper annular rings adhesively attached to outside cylinder tube 44, the entrance face. Inside perforated metal tube 45 is the exit face of filter 30 and center space 46. Cylindrical space 46 communicates with outlet tube 37 and provides unobstructed by-pass path from filter bottom 47 and a safety closure to be described below. Under normal operation vapor enters space 46 by passing through 25 micron accordion plated phenolic bound filter wood pulp paper 48 through apertures 32. During abnormal operation when filter 30 is clogged vapors pass to space 46. In any case the vapors pass out of unit 20 through outlet tube 29. Filter top 30 is adhesively sealably attached through annular rubber seal ring 49 to top 23 and is held in position by steel spring 50 in case of adhesive failure. Screen 40 is also held in place by spring 50. As illustrated in the exploded view of FIG. 4 the parts are shown as placed in container 21. A fuller view of seal ring 49 is shown as it fits over the end of exit tube 37. Baffle interconnect horizontal member 34 rests on the inside surface of bottom 24 to hold baffle plates 33 in annular space 36 and prevent can collapse in case of unexpected pressure drop. Spring 50 rests on top of member 34 and provides bias pressure to bottom 43 of filter 17 to maintain a seal between ring 49 and top 23. In FIG. 5 bottom 43 is shown with cloth reinforced plasticized polyvinyl chloride tape 52 completely closes off the hidden hole in bottom seal ring 51 which is identical in shape and size to top ring 49. Tear start 53 provides a place for tape 52 to open up in case of high pressure build up to allow direct flow to center space 46 and to exit tube 37. An alternative safety by-pass closure is the commercially available flapper valve wherein a circular tear results with a tab to hold the piece to the ring after the valve tears open.

With device 20 water vapor that collects on screen 40 in a relatively high concentration away from oil and dirt collection on bottom 24, is drawn into intake manifold 12 when engine 10 is started. The engine cleaning process is carried out by the water, after which the engine operates in a standard fashion. It is important that vapor flow from holes 28 not impinge directly on surface 27 which tends to deteriorate the filter rapidly but to cause the vapors to disburse and flow around the inside surfaces of housing 21 to allow for even deposition of solids and high molecular weight materials and to cause the vapor flow to impinge on a relatively large surface area of filter 30. It is preferred that the vapors be directed in a direction generally parallel to a generally oblique angle to the inside surface of container 21 without directly impinging directly on the filter surface.

When engine 10 operation is stopped, unit 20 cools more rapidly then the surrounding equipment because of its lack of bulk and because it is installed not in a heat conduction relationship with engine 10. The more rapid cooling of unit 20 causes vapors within unit 20 to condense. Condensation screen 40 is shown partially hidden in FIG. 2 in cross section in FIG. 3 and more completely in FIG. 4. Condensation screen 40 is constructed of one-quarter inch galvanized steel screen of about 1/32 inch wire. In actual operation a substantial portion of condensation screen 40 will be coated or actually covered with oil or resinous condensate and only upright sections 56 will be free to collect water condensation droplets. Grid intersections 57 of condensation screen 40 are particularly effective in collection of water condensation. In this embodiment, about twenty-eight intersections 57 are shown in vertical portion 56 of condensation screen 40 not in close contact or proximity to other metal. It is preferred that there be at least ten and preferably ten to two hundred fifty intersection condensation points, more preferably 10 to 100 condensation points not touching the interior surface of bottom 24 or bottom 43 of filter 17, such as intersections 57 in condensation screen 40. An alternate method of measuring the effective condensing efficiency, the condensation means is the length of the filament wire. Lengths in the range of 3 to 100 inches are preferred, 20 to 80 inches are more preferred and 30–70 inches are most preferred. It is preferred that there be at least ten vertical grids and at least five horizontal grids not in contact. The use of standard window screen in the place of half inch screen 40 depicted in FIG. 4 tends to provide more cleaning action than is necessary, and tends to clog more easily. While one-half inch square "hardware cloth" is satisfactory, one-quarter inch screen is preferred. Other embodiments of condensation means include expanded metal screen, perforated metal sheet, chicken wire, turkey wire, and any other similar types of materials that form points of condensation for collection of water upon cooling of the vapors.

Although accordion pleated wood pulp paper filters are depicted herein and preferred, other types of filtration means may be utilized, such as fiber glass, metal wool and the like. Filter paper ranging from 10 micron to 40 micron density gives satisfactory results. As the filtration capability approaches 10 microns, good results are obtained but as the filter is made denser it tends to be too restrictive and removes too much material and fills up too fast reducing the life of the unit. As the filtration paper approaches 40 microns satisfactory results are obtained but the filter is less dense and more material passes reducing the effect of the device. Particularly preferred is filter paper rated about 20 to 25 micron density to provide an adequate balance of service life and contaminate removal.

Housing 21 is shown in a cylindrical shape. While this is the preferred design to allow circular flow around the interior periphery surface, other shapes may be utilized. Oblate shapes may be used and box shapes give only somewhat lower level performance. For ease of construction, strength and the best flow characteristics, the cyclindrical shape of housing 21 is preferred. The preferred embodiment utilizing the cylindrical shape housing is particularly effective in providing a flow pattern around the interior surface of housing 21 that participates in the deposition of particulate and high molecular weight impurities on the interior surface of housing 21. This flow causes deposition through centrifugal force, against the interior surface of housing 21. Thus, the removal of impurities is accomplished not only through filtration but also by deposition on the interior surface of housing 21 and the internal parts of unit 20.

THE FOLLOWING EXPERIMENTS ARE PROVIDED TO ILLUSTRATE THE USE OF THIS INVENTION

1. The device shown in FIG. 2 is installed in a 1978 Pontiac automobile powered by a standard V-6 gasoline powered internal combustion engine. Before installation of the device, the gasoline usage is carefully monitored over a planned course, including urban and suburban driving of stop and go driving of fourteen stops. The car attains 19.7 miles per gallon of lead-free gasoline. After installation of the device described in FIG. 2, the same automobile and driver, with no other modifications, attains a mileage of 24.6 miles per gallon driven over the same course. The gas usage improvement is 24.9% with the device installed.

2. A 1980 Chevrolet step van with automatic transmission, powered by a standard eight cylinder engine is driven over a set course with four stops. Without the device of FIG. 2 the gasoline usage is 8.0 miles per gallon. After installation the same van is driven by the same driver over the same source to achieve 10.1 miles per gallon for a 26% increase.

3. The device of FIG. 2 is installed in automobile and van of Tests 1 and 2. Emissions tests with a Sun Model IR Tester are run both before and after installation and the results are provided in Table 1.

TABLE I

Hydrocarbon (HC) and Carbon Monoxide (CO) Emissions

| | | No Modifications | With Device of FIG. 2 installed |
|---|---|---|---|
| A. Car of Test 1 | HC | 270 | 170 |
| | CO | 7.8% | 7.3% |
| B. Van of Test 2 | HC | 350 | 250 |
| | CO | 7.0% | 5.0% |

4. A 1981 Buick Skylark automobile, equipped with the Standard V-6 is tested with the device as pictured in FIG. 2. Control tests are first made without the device connected, on a Sun 2001 Diagnostic Computer, capable of varying speed and load in this "in-place" running test. The standard operating instructions and procedures provided with the 2001 Diagnostic Computer are utilized to obtain the results listed in Table II:

TABLE II

Test Results Without Device Connected

| | MILES | MPH | HP | VACUUM | GALLONS | MPG |
|---|---|---|---|---|---|---|
| (A) | 1 | 60 | 10 | 11.5 | .037 | 27.02 |
| (B) | 1 | 60 | 10 | 11.5 | .037 | 27.02 |
| (C) | 1 | 60 | 15 | 9.0 | .041 | 24.39 |
| (D) | 1 | 60 | 15 | 9.0 | .040 | 25.00 |
| (E) | 1 | 60 | 20 | 6.5 | .046 | 21.75 |
| (F) | 1 | 60 | 20 | 6.5 | .048 | 20.83 |
| (G) | 1 | 30 | 10 | 10.0 | .061 | 16.39 |
| (H) | 1 | 30 | 10 | 10.0 | .064 | 15.63 |

The average mileage of tests A and B is 27.02 MPG.
The average mileage of tests C and D is 24.69 MPG.
The average mileage of tests D and E is 21.27 MPG.
The average mileage of tests G and H is 16.00 MPG.

Subsequent to that test, the device pictured in FIG. 2 is installed in the automobile, and with no other changes is driven a distance of 600 miles using standard driving conditions in both urban and suburban areas, maintaining the device connected at all times and with no other changes in the automobile. Subsequent to that 600 miles being placed on the automobile with the device installed, the tests A–H are repeated as tests I–P with the results shown in Table III:

TABLE III

Performance with Device of FIG. 2 Connected

| | MILES | MPH | HP | VACUUM | GALLONS | MPG |
|---|---|---|---|---|---|---|
| (I) | 1 | 60 | 10 | 11.5 | .030 | 33.33 |

TABLE III-continued

| Performance with Device of FIG. 2 Connected | | | | | | |
|---|---|---|---|---|---|---|
| | MILES | MPH | HP | VACUUM | GAL-LONS | MPG |
| (J) | 1 | 60 | 10 | 11.5 | .033 | 30.30 |
| (K) | 1 | 60 | 15 | 9.0 | .038 | 26.32 |
| (L) | 1 | 60 | 15 | 9.0 | .037 | 27.03 |
| (M) | 1 | 60 | 20 | 6.5 | .044 | 22.73 |
| (N) | 1 | 60 | 20 | 6.5 | .044 | 22.22 |
| (O) | 1 | 30 | 10 | 10.0 | .049 | 20.41 |
| (P) | 1 | 30 | 10 | 10.0 | .048 | 20.83 |

The average mileage of tests I and J is 31.81 MPG.
The average mileage of tests K and L is 26.67 MPG.
The average mileage of tests M and N is 22.47 MPG.
The average mileage of tests O and P is 20.62 MPG.

It should be understood that while the present invention has been described in considerable detail with respect to specific embodiments thereof, it is not to be considered limited to those embodiments but may be used other ways without departure from the spirit of the invention or the scope of the appended claims.

I claim:

1. In a vehicle having an internal combustion engine having an air intake means comprising a carburetor and an intake manifold, a crank case, a combustion chamber with associated valve means, a positive crank case valve ventilation means, vapor conduit connection between the positive crank case ventilation valve means and the air intake means the improvement comprising:

a housing connected in the conduit between the crank case ventilation valve means and the air intake means, an inlet flow means in the housing connected through the conduit of the crank case ventilation valve means, with flow disbursing means inside the housing dividing and directing vapor flow in a direction parallel to oblique to the interior surface of the housing, a filter means located in the central portion of the housing having an entrance face and an exit face capable of removing particulate impurities and high molecular weight by-products passing through the conduit but passing essentially all vapors to the exit face, a sealing means to seal a flow cavity from the exit face of the filter means against the interior surface of the housing to allow flow communication from the exit face to an outlet means in the housing communicating with the conduit to the air intake means, a spring means creating a bias pressure against the filter means and against the sealing means.

a safety by-pass means comprising a passage to allow vapors to pass directly from the inlet means to outlet means without passing through the filter means and a closure of the passage capable of opening only upon pressure build-up in the housing, and a condensation means positioned in the housing, capable of collecting and holding water condensate separate from any accumulated solid particulate, solid deposits, or heavy oily liquid condensate collected within the housing.

2. The improvement of claim 1 wherein the condensation means is located in the housing directly in the path of the vapor flow.

3. The improvement of claim 1 wherein the condensing means has at least ten condensation points not in physical contact with the interior surface of the housing.

4. The improvement of claim 3 wherein the condensing means is a metal screen.

5. The improvement of claim 4 wherein the screen has at least ten vertical grids and at least five horizontal grids not in physical contact with the interior of the housing.

6. The improvement of claim 5 wherein the condensing means has ten to two hundred and fifty condensation points not in physical contact with the interior surface of the housing.

7. The improvement of claim 4 wherein the screen is one-quarter inch grid and is held under the filter means and extends upwardly into the vapor flow between the entrance face of the filter means and the interior surface of the housing.

8. The improvement of claim 1 wherein a baffle means positioned in the housing directly in the path of the inlet flow of a shape to disrupt the laminar flow of the vapor.

9. The improvement of claim 8 wherein the baffle means is a pair of metal plates placed between the inlet face of the filter means and the interior surface of the housing of a size to partially disrupt the laminar flow.

10. The improvement of claim 1 wherein the housing is cylindrical and constructed of a ductile material capable of deflecting with pressure changes within the housing.

11. The improvement of claim 10 wherein a flow path is formed between a cylindrically shaped filter means positioned in the center of the housing wherein the filter means has the inlet face on the outside surface of the cylinder with a hollow interior providing the exit face open at both end of the cylindrical filter.

12. The improvement of claim 1 wherein the filter means is a cylindrical tubular shape with the outside surface having the inlet face and the inside surface having the exit face opening to a clear open passageway the length of the cylinder, with the top of the cylinder sealed against the top of the housing around the outlet flow means, and the bottom of the center section sealed with the safety by-pass means comprising a cloth tape with a slight tear start, wherein the tear strength of the tape is chosen to open the by-pass only with substantial pressure build-up due to filter clogging.

13. The improvement of claim 1 wherein the filter means is a filter capable of stopping particulate in the size range of 10 microns to 40 microns.

14. The improvement of claim 13 wherein the filter means is an accordion pleated wood pulp paper filter.

15. The improvement of claim 14 wherein the filter means is a twenty to twenty-five micron rated paper filter.

16. The improvement of claim 1 wherein the flow disbursing means is a vertical tube connected to the inlet flow means closed at the far end and having a plurality of ports along the tube opening parallel to the interior wall of the housing directing flow around the interior periphery of the cylindrical housing.

17. The improvement of claim 1 wherein the safety by-pass means closure comprises a film sealably attached across and closing the passage, wherein the film is provided with a tear start means, wherein the length and shape of the tear and the tear strength of the film is chosen to resist opening during normal use but tear open with substantial pressure build-up due to clogging.

18. The improvement of claim 17 wherein the film is a cloth reinforced, flexible, adhesive tape.

19. The improvement of claim 18 wherein the film is a cloth reinforced, plasticized polyvinyl chloride adhesive tape.

20. The improvement of claim 17 wherein the closure is a circular flapper valve.

* * * * *